US005583336A

United States Patent [19]

Kelly

[11] Patent Number: 5,583,336

[45] Date of Patent: Dec. 10, 1996

[54] HIGH THROUGHPUT ELECTRON ENERGY ANALYZER

[76] Inventor: Michael A. Kelly, 35 Lerida Ct., Portola Valley, Calif. 94028

[21] Appl. No.: 550,164

[22] Filed: Oct. 30, 1995

[51] Int. Cl.[6] ..... H01J 49/46

[52] U.S. Cl. ..... 250/305

[58] Field of Search ..... 250/305

[56] References Cited

U.S. PATENT DOCUMENTS

| | | | |
|---|---|---|---|
| 3,822,382 | 7/1974 | Koike | 250/305 |
| 4,810,883 | 3/1989 | Turner | 250/305 |
| 5,017,779 | 5/1991 | Smith et al. | 250/305 |

OTHER PUBLICATIONS

Avignone et al., Nuclear Instruments and Methods, vol. 107, No. 3, Mar. 1973, pp. 453–459.

*Primary Examiner*—Jack I. Berman

*Attorney, Agent, or Firm*—James E. Eakin

[57] ABSTRACT

A charged particle energy analyzer having higher sensitivity than conventional analyzers inserts a substantially parallel beam of charged particles into a uniform magnetic field at an angle to the field direction. The charged particles travel along the field direction and rotate perpendicular to it, forming helical trajectories. After traveling a given distance in the field direction, the total rotation each charged particle has undergone is measured. Because the total rotation is uniquely related to the energy of the particle, a spectrum showing the energy distribution of all the particles in the beam can be derived from these measurements. The enhanced sensitivity of this analyzer results from its ability to simultaneously analyze all the particles in a beam having a large energy spread.

20 Claims, 3 Drawing Sheets

HIGH THROUGHPUT ELECTRON ENERGY ANALYZER

FIELD OF THE INVENTION

The present invention relates to devices for separating electrons or other charged particles according to their energies. Specifically, the present invention relates to an energy analyzer with enhanced sensitivity for simultaneous analysis of all particles in a collimated beam.

BACKGROUND OF THE INVENTION

Electron energy analyzers are essential components of a number of electron devices, most particularly analytical instruments which determine the composition and properties of materials based upon the energy distribution of electrons their surfaces emit when stimulated appropriately. Two widely used instruments which utilize electron energy analyzers are x-ray photoelectron spectrometers (XPS), and auger electron spectrometers (AES). In these systems, the resolution (ability to distinguish different elements and chemical bonds in the material being analyzed) and sensitivity (the minimum detectable level of these constituents) of the instruments are largely determined by the electron energy analyzer. To be useful in these applications, an electron energy analyzer must be able to distinguish electrons of energies on the order of 1000 electron volts which differ in energy by less than 1 electron volt.

Two types of electron energy analyzers are in wide usage today: the Cylindrical Mirror Analyzer (CMA) and the Spherical Capacitor Analyzer (SCA), both electrostatic analyzers. Both are described extensively in the literature. There are also a wide variety of other types of electron energy analyzers which have been described, see, for example, J. C., Riviere, *Surface Analytical Techniques,* Clarendon Press (1990), p. 52.

The analyzers discussed above have limited sensitivity: all are capable of selecting only a single energy or a small range of energies to be routed to a detector. Typically, both the CMA and the SCA are able to accommodate only a fraction of a percent of the electrons emanating from a sample under analysis, and must be sequentially scanned over a broad range of energies in order to develop a complete spectrum which identifies the material being analyzed. As a result, the material must be illuminated by an intense beam of electrons or x-rays in order to perform the analysis. This causes undesirable sample damage, and slows the analysis considerably.

A long felt need exists for an electron energy analyzer with increased resolution and sensitivity for simultaneously detecting and analyzing all energies of all particles in a beam having a multitude of energies.

SUMMARY OF THE INVENTION WITH OBJECTS

A general object of the present invention is to provide an electron energy analyzer that overcomes the drawbacks and limitations of the prior art.

A specific object of the present invention is to improve the speed, performance, and cost-effectiveness of surface analyzing instruments, such as Auger Electron Spectroscopy (AES) and Electron Spectroscopy for Chemical Analysis (ESCA), which depend upon determining the energy of electrons emitted from materials.

One more specific object of the present invention is to provide an improved electron energy analyzer to increase the speed of analysis, thereby improving the cost-effectiveness of the instrument, improve sensitivity, and minimize the damage caused by analysis on less stable materials.

Another specific object of the present invention is to provide an energy analyzer which collects as many electrons as possible from the sample, so that a maximum amount of information can be extracted during the analysis.

An additional specific object is to provide an energy analyzer which analyzes electrons of a wide variety of energies simultaneously so that a nearly complete spectrum of them can be can be accumulated in parallel thereby eliminating the need to repeatedly scan the electron energy analyzer over a range of energies.

Yet another specific object of the present invention is to provide an efficient energy analyzer having a simpler instrument design.

An energy analyzer embodying the principles of the present invention operates by injecting a nearly parallel beam of electrons, or other charged particles, into a uniform magnetic field in such a way that each particle rotates about the field direction and executes a helical trajectory in the field. After traveling along the magnetic field direction for a given distance, the total rotation perpendicular to the field is measured for each particle. This measurement is performed in the preferred embodiment by causing the particles to be imaged onto a detector so that all the particles of a given energy strike a given region of the detector, independent of their position in the incident beam. As a result, the energy distribution of particles present in the incident beam is mapped into a spatial distribution on the detector, a spiral in the preferred embodiment. Thus, by measuring the distribution of particles striking the detector, the energy spectrum of the incident beam can be obtained.

These and other objects, advantages and features of the present invention will become more apparent upon considering the following detailed description of preferred embodiments, presented in conjunction with the accompanying drawings.

DETAILED DESCRIPTION OF THE PREFERRED EMBODIMENT

Figure 1:
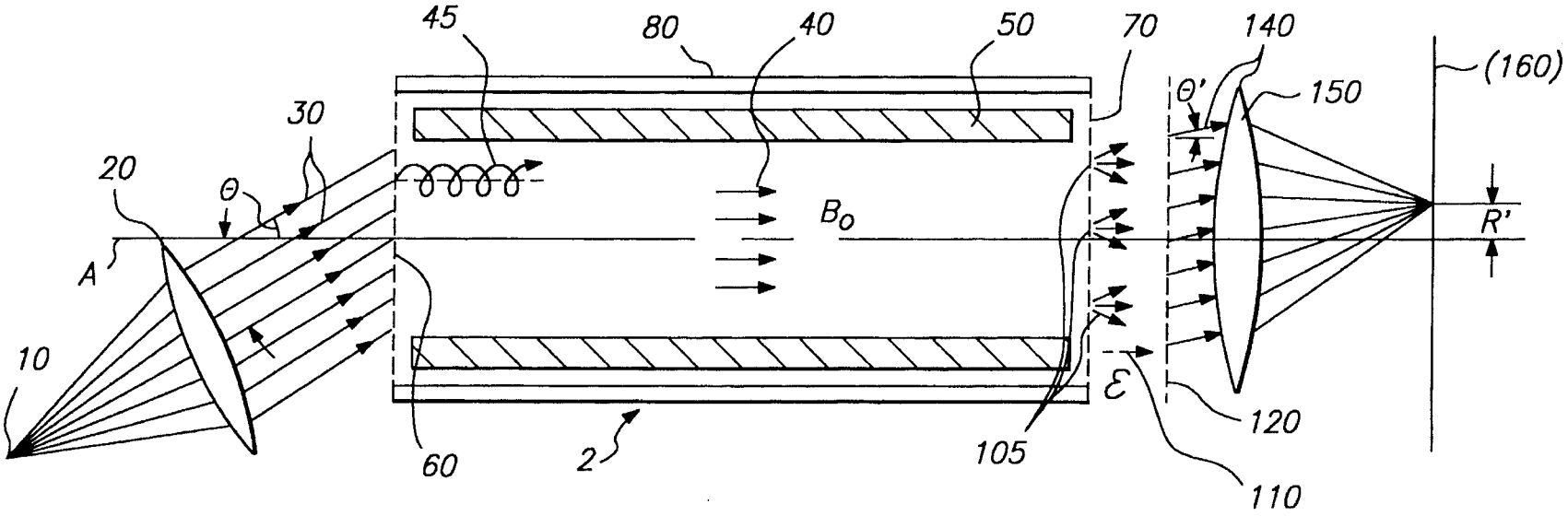
FIG. 1. is a partial cross sectional view of preferred embodiment of an energy analyzer embodying the principles of the present invention.

FIG. 1 shows the basic configuration of an energy analyzer 2 embodying principles of the present invention. Charged particles from a diverging source 10 (such as a small region on a material surface emitting electrons) are incident upon a converting means 20. Convening means 20 consists of a conventional low aberration electrostatic lens which converts the charged particle flux 10 into a nearly parallel beam 30. It will be recognized by those skilled in the an that the energy range presented to the analyzer may be expanded or contracted by using an immersion lens as the converting means 20 where the exiting energy of the charged particles is different from the incoming energy.

The axis of the beam 30 is oriented at an angle θ with respect to the axis "A" of a uniform magnetic field 40 created by a conventional electromagnetic solenoid 50. Any non-zero angle θ can be used in principle for the beam 30, but a preferred angle is several times larger than the maximum angular divergence of the nearly parallel beam 30, in the range between approximately 5 to 30 degrees.

The beam 30 enters the magnetic field region 40 at the defined angle θ through a field termination means consisting of a mesh 60 of magnetically permeable material. The mesh 60 reduces the magnetic field outside the field region 40 to a negligible value, thereby shielding the beam 30 prior to entry into the field region 40. The holes in the mesh 60 are small enough that the effects of field non-uniformities caused by the holes (fringing fields) have a negligible effect on the particle trajectories when passing from the field-free region, where the charged particle source is typically located, into the uniform magnetic field region 40. To further minimize the fringing fields surrounding the solenoid 50, a magnetically permeable tube 80 is placed over the outside of the solenoid. The tube 80 completes the magnetic circuit: lines of magnetic force enter a magnetically permeable mesh 70 at the exit end of the uniform field region 40 and are conducted around to the other permeable mesh 60 through the tube 80.

The particles in the beam 30 execute helical trajectories 45 along the field direction in the field region 40, and the period of each (i.e., the distance each particle travels along the field direction while traveling a full circle perpendicular to the field) depends upon the particle's energy, not its position, in the incident beam 30.

To understand this process, consider a particle of mass m, charge e and energy $E_o$ entering a uniform magnetic field $B_o$ at an angle θ. The particle will move in a helical path at a velocity $v_p=v_o \cos\theta$ parallel to the magnetic field lines, and v=y sin θ parallel to the magnetic field lines, and $v_y=v_o \sin\theta$ transverse to the field, where θ is the angle between the initial velocity $v_o$ and the field direction. The transverse velocity results in a circular motion perpendicular to the field lines of frequency $\omega=eB_o/m$. As the particle progresses along the field, the circular motion can be characterized by a radius $r=mv_t/eB_o$ and an angle θ in the plane perpendicular to the field, where ϕ is zero as the particle enters the field, 360° after the first complete rotation, 720° after the second, etc. The magnetic field 40 is sufficiently strong so that the radius of the particle trajectory 45 is small compared to the diameter of the uniform magnetic field 40, and would typically lie in the range of from 100 to 20,000 gauss, depending upon the mass of the charged particles being analyzed. After traveling some distance l in the field, the angle θ with respect to its initial direction, will be $$\phi=180.eB_o l/(\pi(2E_o m)^{1/2}\cos\theta) \text{ degrees}$$

so its total rotation is proportional to $(Eo)^{-1/4}$. If the particle exits the field at this point, it will be traveling at an angle θ with respect to the field axis, and at an angle ϕ from its original azimuthal direction, which is proportional to $(Eo)^{-1/4}$. Hence the angle ϕ of each emerging particle is a function of its energy.

For example, the trajectory of a 1000 eV electron entering a 500 Gauss field at an angle of θ =20° would be a helix about 1.4 mm in diameter and would have a period of 1.2 cm along the field direction. A typical diameter for the magnetic field region 40 for such a case would be 2–5 cm. The length of the region 40 is selected so that particles of different energies have measurably different rotations at the exit end; a longer field region 40 tending to increase the accuracy of the measurement. For the 1000 eV electron, a length of 10 cm would result in a total rotation of about ϕ=2500°, or a little under 7 complete rotations.

The particles travel through the magnetic field region 40 in the axial direction "A", and exit through the second magnetically permeable mesh 70, which has holes in it small enough to reduce any fringing fields to a negligible value, so that the direction of the particles which pass through the mesh 70 are not significantly affected. Hence, the particles emerge from the mesh in the direction they were traveling at the end of the uniform magnetic field region 40. This direction is defined by (1) θ, the angle their trajectories make with the field axis "A", which is the same as the angle the particles had upon entering the magnetic field region 40, and (2) ϕ, the particles azimuthal rotation with respect to the plane in which they entered the field region 40, which depends upon the total rotation within the magnetic field region 40. The amount of rotation therefore depends upon the particle's energy. For example, in the case of the 1000 eV electron cited above, the particle underwent a total rotation of 2500°, or 6 full rotations plus an additional 340°. The particle would therefore emerge with an azimuthal angle of ϕ=340° relative to the plane in which it entered.

One way of measuring emerging angles of charged particles is to place a low aberration electric or magnetic lens, such as the lens 150 shown in FIG. 1, on the magnetic field axis "A" so that it intercepts the emerging beam 105 and images it on a detector, such as the detector 160, located one focal length (f) away from the lens. Such a lens focuses all of the charged particles traveling parallel to each other at a single point. Those traveling parallel to the axis of the lens are thus imaged on the axis, those traveling in some other direction are imaged off the axis. Specifically, a charged particle of energy $E_o$ emerging from the magnetic field 40 at an angle θ with respect to the lens axis and an azimuthal angle ϕ will then strike the detector at a single place, at a distance R=fsinθ from the lens axis, and at the azimuthal angle ϕ which is related to its energy by the relationship above.

Since all the particles of a particular energy strike the detector at a point having a particular value of ϕ, the energy of each particle in the beam can be determined by observing the angle ϕ at which it strikes the detector. The locus of points at which electrons of a wide range of energies strike the detector is therefore a circle of radius R. If the range of energies is small enough so the spread in the angle ϕ is less than one full circle (360°), then all of the electrons will strike the detector in an are of less than 360 in extent. However, if the energy range is larger so that it corresponds to a spread in ϕ greater than 360°, electrons of higher energy will overlap those of lower energy, and one spot on the detector will correspond to more than one energy.

In order to avoid overlapping energies at the detector 160, prior to interception of the particles 105 by the lens 150, the emerging particles 105 next travel through a region in which a uniform electric field 110 is applied parallel to the magnetic field axis "A", produced by a voltage applied between the magnetically permeable mesh 70 and a metal screen 120. The field 110 accelerates the particles 105 in the axial direction "A" but does not change their velocity in the perpendicular direction, causing the exit angle θ to be decreased to some value θ', thereby eliminating overlapping energies at the detector. The addition of the electric field 110 parallel to the magnetic field axis "A" (either in or after the magnetic field) will cause the particles to strike the detector 160 closer or farther from the lens axis, depending upon their energy, so $R'=f\sin\theta'$, where $\theta'$ is the angle a particle of energy Eo makes with the lens axis after acceleration or deceleration in the electric field 110 which will now be a function of the particle's energy. Specifically, for a particle of initial energy Eo accelerated through a potential of V volts, this angle will be $$\theta'=\tan^{-1}(\tan\theta/(1+eV/(E_o\cos\theta))).$$

For the case of the 1000 eV electrons entering the analyzer 2 at an angle of $\theta=20°$ as described above, if the electrons were accelerated through a 500 volt potential by the electric field 110, the emerging angle $\theta'$ would be 13.3° for 1000 eV electrons, and 15 for 1500 eV electrons, and 10° for 500 eV electrons. Thus lower energy particles leave the uniform electric field region 110 with a smaller angle $\theta'$ than higher energy particles, but their azimuthal angle $\phi$ is not changed. All particles of a given energy, shown by the trajectories 140, exit as a nearly parallel beam traveling in a unique direction defined by the two angles $\theta'$ and $\phi$.

The particles 140 next are focused on the planar detector 160 by the low aberration electrostatic lens 150. The planar detector 160 is a conventional position sensitive detector which registers the location of each charged particle striking it. Several types of such detectors are available commercially, a preferred type is a phosphor screen which emits light when a charged particle strikes it, and the light is transferred to an intensified solid state imaging detector, similar to a high sensitivity video camera. Another such detector utilizes microchannel plate electron multipliers and a resistive anode encoder to detect the particles, and to a processor to compute the position of each particle as it arrives.

The distance between the lens 150 and the detector 160 is set to be equal to the focal distance of the lens 150, so that particles 140 traveling parallel to each other all focus at a point. Those particles traveling parallel to the axis of the lens 150 are focused on the axis, and those traveling in some other direction are focused a distance off the axis which is determined by the angle $\theta'$ as previously discussed. The azimuthal angle $\phi$ is not changed, so that all the particles 140 of a given energy are focused at a unique point, thereby resulting in points on the detector 160 which correspond to unique energies present in the incident beam 30. Thus, for a wide range of energies, the locus of electrons striking the detector 160 is a spiral 230 as shown in FIG. 2B). If the electric field 110 is accelerating, the higher energy particles will be imaged toward the outside of the spiral, whereas a decelerating field will cause the lower energy particles to be imaged toward the outside. A similar spiral image can be obtained without applying the uniform electric field 110 when the angle at which the particles enter the uniform magnetic field region 40 is a function of their energy, so the incoming angle $\theta$ is a function of the particle's energy.

Thus, by dispersing the charged particles on the detector 160 in a spiral following passage through the electric field 110, every energy present in the incident flux corresponds to a unique position on the detector 160. Using conventional position sensitive detectors and digital signal processing techniques, a spectrum of the beam intensity as a function of energy can be made by detecting the number of particles which strike the detector 160 at each point along the spiral.

Figure 2A:
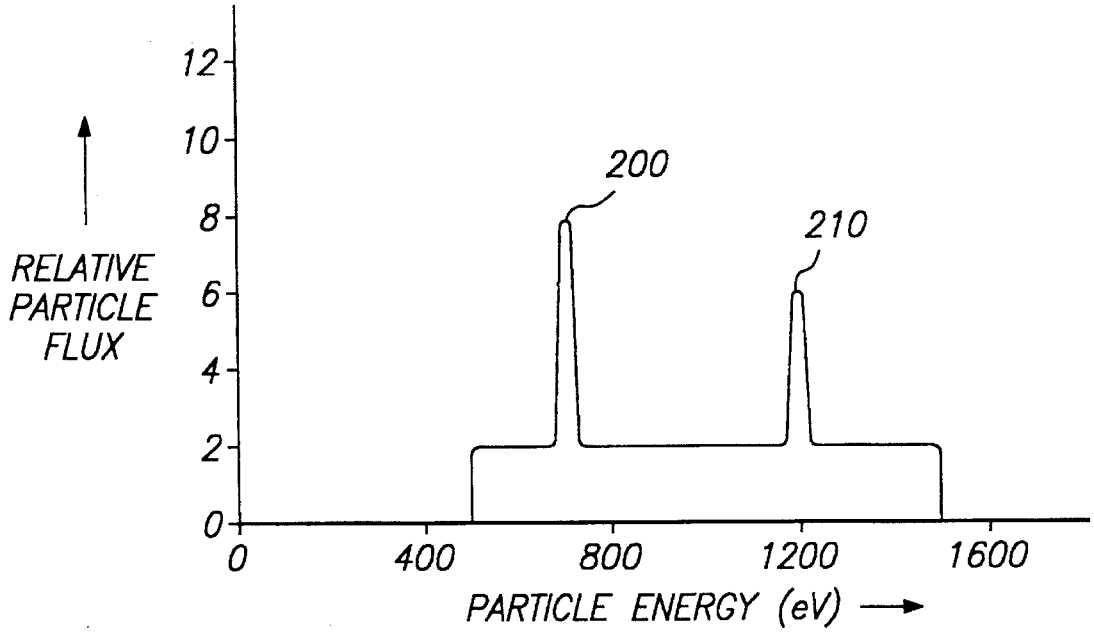
FIG. 2A is a graphical representation of a typical energy distribution of particles in a beam to be analyzed.
Figure 2B:
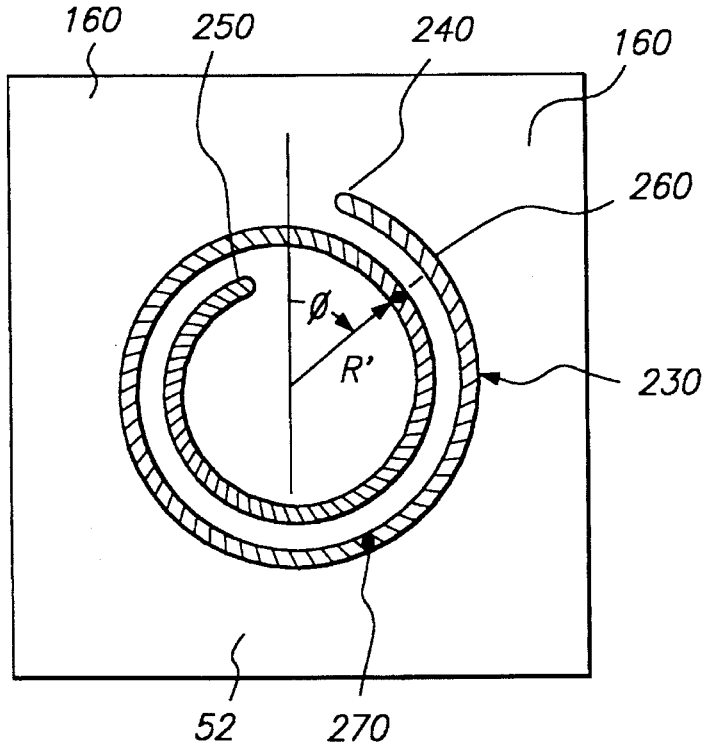
FIG. 2B is a view of the distribution of energies on a detector following passage through the energy analyzer of FIG. 1.

FIG. 2A shows a hypothetical wide energy distribution of electrons from a beam illuminating the imaging detector 160. Electrons of energies between 500 and 1500 eV are present, with higher numbers present at 700 and 1200 eV, as evidenced by the two peaks 200, 210 in the distribution.

The image formed on the detector face 160 from this distribution is sketched in FIG. 2B. The spiral crosshatched region 230 shows the location on which substantially all of the electrons strike the detector 160, each electron being imaged at a position described by R', the distance from the axis 152 of the lens 150, and $\phi$, the azimuthal angle. The outermost end 240 of the spiral region 230 corresponds to electrons of 1500 eV, and the innermost end 250 to electrons of 500 eV. The two darker regions 260, 270 correspond to the two high intensity peaks shown in FIG. 2A, 200 and 210, respectively. The width of the crosshatched region 230 (and the energy resolution of the analyzer 2) is determined primarily by the degree of parallelism in the incident beam and by the aberrations in the lenses 20, 150 and the meshes 60, 70. The aberrations can, in principle, be made as small as desired by decreasing the size of the openings in the meshes 60, 70, and by increasing the size of the lens elements 20, 150.

Figure 3:
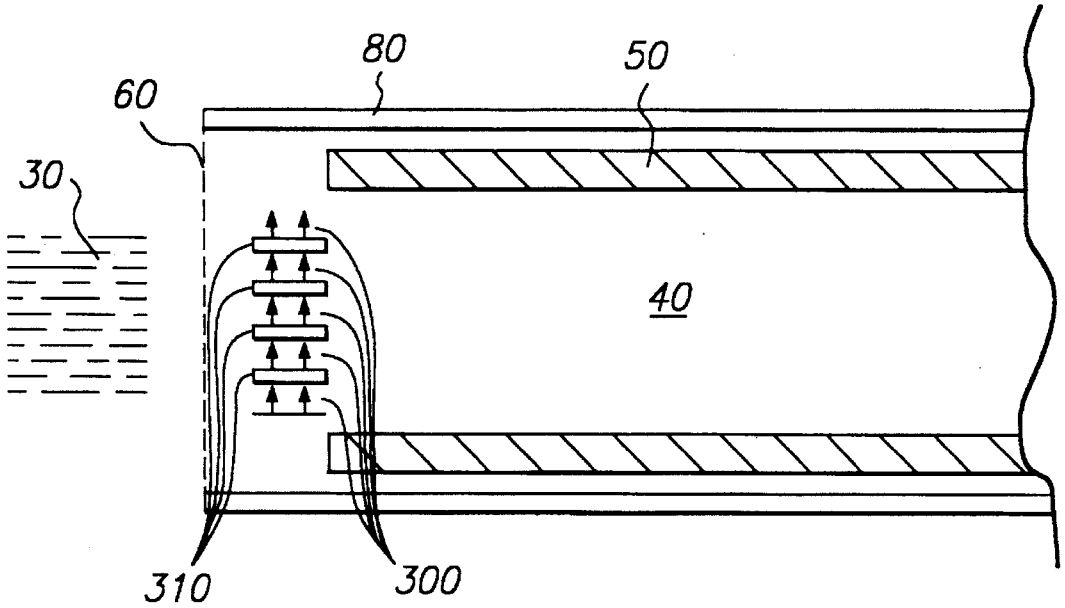
FIG. 3 is a cross sectional view of an alternate injection means.

FIG. 3 shows an alternate method for introducing the beam 30 into the magnetic field region 40 in which the substantially parallel particle beam 30 enters the magnetically permeable mesh 60 at 90 degrees relative to the plane of the mesh 60 into an essentially uniform transverse electric field 300 set up by pairs of parallel electrodes 310. The strength of this electric field 300 is selected so that charged particles 30 are deflected to acquire a velocity in a direction perpendicular to both the electric and magnetic fields which are perpendicular to each other. As the particles exit the electric field region 300, all those particles of a given energy move essentially parallel to each other, as the entrance conditions to the magnetic field region 40 requires. The electric field 30 can also be placed outside the magnetic field 40 to create the appropriate entrance conditions, but the configuration shown has a somewhat higher energy resolution. Transverse magnetic fields, either within or before the uniform magnetic field region 40 can also be used to create the necessary relationship between the incident beam 30 and the uniform magnetic field region 40.

It will be recognized by those skilled in the art that the energy analyzer 2 of the present invention can be configured in virtually any other manner and may be used in any system requiring the analysis of energies, such as XPS, AES, UPS and ESCA. According, the aspects discussed herein are for illustration only and should not limit the scope of the invention herein which is defined by the claims.

What is claimed is:

1. A charged particle energy analyzer comprising:

means for creating a substantially uniform magnetic field within a region and defining a cross section and a length, a direction of the magnetic field extending along the length thereof;

injection means for inserting a flux of charged particles having different energies and traveling in entrance trajectories into the magnetic field so that charged particles of a same energy travel substantially parallel to each other after insertion and rotate about a field direction following helical trajectories, the magnetic field having a strength sufficient to cause the helical trajectories of the charged particles to be contained within the cross section of the magnetic field; and measuring means for determining a total rotation of each charged particle after traveling a fixed distance along the field direction, the measuring means relating the total rotation to the energy of the particle.

2. The analyzer of claim 1 further comprising inlet field termination means operatively associated with a permeable housing means surrounding the region and the means for creating the substantially uniform magnetic field, the inlet field termination means reducing magnetic fields outside of the permeable housing means to a negligible value.

3. The analyzer of claim 2 wherein the means for creating a substantially uniform magnetic field is a solenoid.

4. The analyzer of claim 1 where the measuring means comprises:

outlet field termination means for allowing the charged particles to maintain exit trajectories while exiting the region with the uniform magnetic field; and dispersion means for causing the exiting charged particles to strike a position sensitive detector so that charged particles having the same energy occupy a unique position on the detector.

5. The analyzer of claim 2 where the injection means comprises:

conversion means for converting the charged particles emanating from a source into a substantially parallel beam; and the inlet field termination means for allowing the charged particles to travel from a substantially field free region outside of the permeable housing means into the magnetic field with negligible perturbation of their entrance trajectories, the substantially parallel beam passing through the inlet field termination means at a selected angle into the magnetic field.

6. The analyzer of claim 5 in which the conversion means is a conventional low aberration electrostatic lens.

7. The analyzer of claim 5 where the conversion means is a conventional magnetic lens.

8. The analyzer of claim 5 wherein the conversion means further defines a retarding field means for altering a speed of the charged particles emanating from the source to change the energies being analyzed.

9. The analyzer of claim 5 wherein the conversion means defines a diverging magnetic field for improving parallelism of the beam.

10. The analyzer of claim 4 wherein the inlet field termination means and the outlet field termination means are both magnetically permeable mesh positioned, respectively, at an entrance end and an exit end of the magnetic field for reducing fringing fields.

11. The analyzer of claim 2 where the injection means comprises:

conversion means for converting the charged particles emanating from a source into a substantially parallel beam;

deflection means comprising a transverse field means for deflecting the charged particles into a path having a selectable angle to the axis of the magnetic field; and the inlet field termination means for allowing the charged particles to travel from a substantially field free region into the magnetic field with negligible perturbation of their entrance trajectories.

12. The analyzer of claim 11 in which the deflection means is a transverse field positioned within a beginning region of the magnetic field.

13. The analyzer of claim 4 in which the dispersion means is a conventional low aberration lens for imaging the particles exiting the magnetic field onto a detector means.

14. The analyzer of claim 4 wherein the dispersion means defines a region containing an electric field parallel to the magnetic field for altering a speed of the charged particles so that a beam of charged particles having a large range of energies forms a spiral image on the detector.

15. A method for measuring the energy of a charged particle comprising observing a change in a direction of motion of the charged particle after allowing the charged particle to travel a selected distance along a substantially uniform magnetic field.

16. A method for spatially separating a beam of charged particles having different energies, the method comprising the steps of:

injecting the beam of charged particles into a substantially uniform magnetic field at a selected angle thereto;

allowing the beam of charged particles to travel a selected distance along a direction of the uniform magnetic field to spatially separate the beam of charged particles so that each particle of a given energy travels in a unique direction;

extracting the spatially separate beam of charged particles from the uniform magnetic field; and passing said extracted, spatially separate beam through a charged particle lens so that each particle of a given energy is focused at a unique point in space.

17. The method of claim 16 further comprising the step of positioning a magnetically permeable material, having holes therethrough sized to allow the creation of negligible fringing fields at the holes, to terminate the substantially uniform magnetic field so that the beam of charged particles enters the magnetically permeable material at trajectories substantially perpendicular thereto and substantially parallel to a field direction of the uniform magnetic field, the trajectories substantially unaffected by the negligible fringing fields.

18. The method of claim 17 further comprising the step of subjecting the extracted, spatially separate beam to an electric field to decrease exit angles of the charged particles and to accelerate the extracted beam.

19. The method of claim 17 further comprising the step of passing the beam of charged particles through a transverse electric field prior to entry into the uniform magnetic field.

20. The method of claim 17 further comprising the step of providing a detector for deposit of the particles focused at the unique points in space.

* * * * *